US010683145B2

(12) United States Patent
Irizar Gonzalez et al.

(10) Patent No.: US 10,683,145 B2
(45) Date of Patent: Jun. 16, 2020

(54) EASY OPENING CONTAINER

(71) Applicants: VIDRALA S.A., Llodio (ES); AINIA, Paterna (ES)

(72) Inventors: Liher Irizar Gonzalez, Llodio (ES); Carlos Enguix Nicolas, Paterna (ES); Pedro Zomeño Alcala, Paterna (ES)

(73) Assignees: VIDRALA S.A., Llodio (ES); AINIA, Paterna (ES)

( * ) Notice: Subject to any disclaimer, the term of this patent is extended or adjusted under 35 U.S.C. 154(b) by 17 days.

(21) Appl. No.: 16/272,106

(22) Filed: Feb. 11, 2019

(65) Prior Publication Data

US 2019/0248551 A1 Aug. 15, 2019

(30) Foreign Application Priority Data

Feb. 12, 2018 (EP) ..... 18382077

(51) Int. Cl.
*B65D 41/04* (2006.01)
*B65D 43/02* (2006.01)

(52) U.S. Cl.
CPC ..... *B65D 41/0471* (2013.01); *B65D 43/02* (2013.01); *B65D 43/0231* (2013.01); *B65D 2101/0007* (2013.01); *B65D 2543/00092* (2013.01); *B65D 2543/00537* (2013.01); *B65D 2543/00824* (2013.01)

(58) Field of Classification Search
CPC ..... B65D 41/0471; B65D 43/02; B65D 43/0231; B65D 2101/0007; B65D 2543/00824; B65D 2543/00092; B65D 2543/00537
USPC ..... 215/330, 333; 220/288–304, 323, 325
See application file for complete search history.

(56) References Cited

U.S. PATENT DOCUMENTS 361,369 A * 4/1887 Petit ..... B65D 51/20 215/257
2,837,263 A * 6/1958 Nasello ..... B65D 43/26 229/125.19
3,606,136 A * 9/1971 Hegardt ..... B65B 7/2878 220/359.4

(Continued)

FOREIGN PATENT DOCUMENTS

CH 359611 A 1/1962
DE 650249 C 9/1937

(Continued)

OTHER PUBLICATIONS

Extended European Search Report in corresponding European Application No. 18382077.8, dated Aug. 22, 2018, 8 pages.

*Primary Examiner* — James N Smalley
(74) *Attorney, Agent, or Firm* — Edell, Shapiro & Finnan, LLC

(57) ABSTRACT

An easy opening container is provided that includes a body with an opening, and a lid for the opening. The opening includes a neck having at least one screw thread and a sealing edge. The closing lid having an upper part and a peripheral skirt, the skirt including a free edge. The free edge has a plurality of inwardly extending lugs, the lugs being configured for being coupled with the screw thread when the lid is closed on the opening. The container further includes at least one element for easy opening, such as a strip, between the screw thread and the lugs, the element being configured for being removed before opening the lid in order to make the opening easier.

18 Claims, 6 Drawing Sheets

(56) References Cited

U.S. PATENT DOCUMENTS

| | | | | | |
|---|---|---|---|---|---|
| 3,820,678 | A | | 6/1974 | Zipper et al. | |
| 3,900,125 | A | * | 8/1975 | Wyler | A45D 40/0068 215/341 |
| 4,629,084 | A | | 10/1986 | Hackelsberger | |
| 4,872,571 | A | * | 10/1989 | Crecelius | B65D 51/20 222/541.1 |
| 5,156,286 | A | * | 10/1992 | Piccard | B65D 51/20 215/232 |
| 5,246,126 | A | * | 9/1993 | Lewis, Jr. | B65D 1/0253 215/232 |
| 5,292,020 | A | * | 3/1994 | Narin | B65D 41/0471 215/330 |
| 5,664,694 | A | * | 9/1997 | Bietzer | B67B 3/20 215/256 |
| 6,082,568 | A | * | 7/2000 | Flanagan | B65D 51/20 215/232 |
| 2003/0160020 | A1 | * | 8/2003 | Oh | B65D 41/04 215/330 |
| 2004/0238477 | A1 | * | 12/2004 | Unsworth | B65D 51/18 215/305 |
| 2005/0006333 | A1 | * | 1/2005 | Merrill | B65D 51/20 215/232 |

FOREIGN PATENT DOCUMENTS

| | | | |
|---|---|---|---|
| EP | 1686070 | A1 | 8/2006 |
| GB | 1319729 | A | 6/1973 |
| GB | 2441327 | A | 3/2008 |
| JP | 2004331199 | A | 11/2004 |
| WO | 98/52833 | A1 | 11/1998 |
| WO | 03018420 | A1 | 3/2003 |

* cited by examiner

EASY OPENING CONTAINER

CROSS-REFERENCE TO RELATED APPLICATIONS

This application relates to and claims the benefit and priority to European Application No. EP18382077.8, filed Feb. 12, 2018.

TECHNICAL FIELD

The present invention relates to containers incorporating means to make the opening of the lid easier.

BACKGROUND

Containers which comprise a body with an opening comprising a neck with at least one screw thread and a lid which allows the screw-on closure of the opening are known. Containers with a twist-off type closure are also known, in which the screw thread comprises a plurality of threads, and the closing lid comprises a peripheral skirt with a free edge comprising a plurality of inwardly extending lugs, the lugs being coupled with the screw thread of the neck of the body of the container when the closing lid is closed on the opening of the body.

GB2441327 describes a container with an easy opening twist-off type closure in which the opening of the lid is made easier by means of an indent arranged in the peripheral skirt of the closing lid.

SUMMARY

Easy opening containers are disclosed that comprises a body with an opening, and a closing lid for closing the opening, the opening having a neck that includes at least one screw thread and a sealing edge. The closing lid comprises an upper part and a peripheral skirt, the skirt having a free edge, the free edge including at least one inwardly extending lug. The lug is configured for being coupled with a screw thread of the neck when the closing lid is closed on the opening of the body.

The containers further comprise at least one element for easy opening housed between at least one screw thread of the neck and at least one lug of the closing lid coupled to the screw thread. The element for easy opening is configured for being removed before opening the closing lid in order to make the subsequent opening of the closing lid easier.

Easier opening of containers of this type is achieved because less opening force is required for opening the closing lid. By removing the element for easy opening from between the screw thread of the neck of the container and the lug of the closing lid, the distance existing between the lug and the sealing edge of the neck of the container decreases, whereby the frictional force existing between the closing lid and the neck decreases, such that the opening force to be applied is lower. This translates into easier opening of the containers, especially for the elderly and particularly with containers having large diameters.

These and other advantages and features will become evident in view of the drawings and the detailed description.

DETAILED DESCRIPTION

There are different easy opening systems for containers with different types of closures. In the context of the present disclosure, container is understood as a recipient intended for storing or preserving something. According to one embodiment the container comprises a body with an opening having a neck with at least one peripheral screw thread, and a closing lid which allows the screw-on closure of the opening. Among containers of this type, those containers with a twist-off type closure are known, in which the screw thread comprises a plurality of threads, preferably from three to eight, and the closing lid comprises an upper part and a peripheral skirt with a free edge comprising a plurality of inwardly extending lugs. When the closing lid is closed on the opening of the body, the lugs are coupled with the screw thread of the neck of the body of the container.

Figure 1:
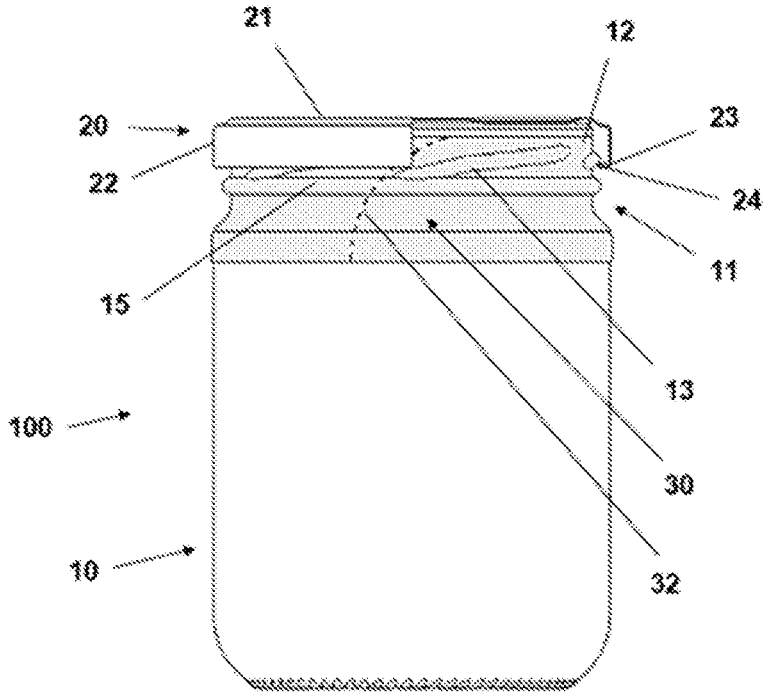
FIG. 1 shows a front view of an embodiment of a container with a partial section of the lid showing the element for easy opening.
Figure 2:
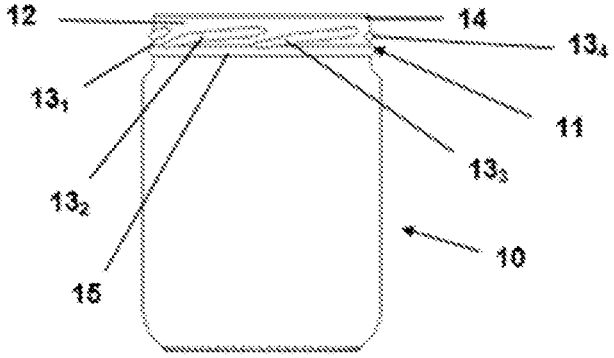
FIG. 2 shows a front view of the body of the container of FIG. 1.

As shown in the embodiment of FIG. 1, a container 100 is provided that comprises a body 10 with an opening 11, and a closing lid 20 for closing the opening 11, the opening 11 comprising a neck 12 comprising at least one screw thread 13 and a sealing edge 14, and the closing lid 20 comprising an upper part 21 and a peripheral skirt 22, the skirt 22 comprising a free edge 23, the free edge 23 including a plurality of inwardly extending lugs 24. The lugs 24 are configured for being coupled with the screw thread 13 of the neck 12 when the closing lid 20 is closed on the opening 11 of the body 10. Given that the container 100 shown in FIG. 1 has a twist-off type closure, in this embodiment, and as shown in FIG. 2 in a front view of the body 12, it comprises six inclined threads 131-136, and the neck 13 comprises a sealing edge 14 in the upper part thereof.

In this embodiment, the body 10 is made of glass, and in other embodiments it may be made of plastic or a rigid material, and it contains a vacuum-preserved product. In this embodiment, the body 10 has a cylindrical shape, and in the upper part thereof it tapers into a curve forming a shoulder and defining the opening 11.

Figure 3:
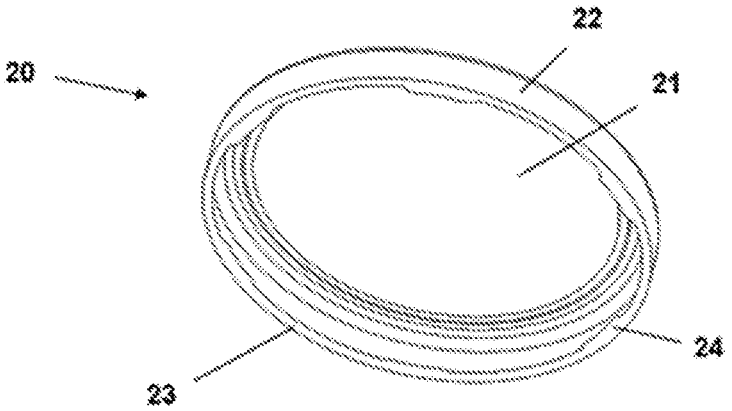
FIG. 3 shows a bottom perspective view of the lid of the container of FIG. 1.
Figure 4:
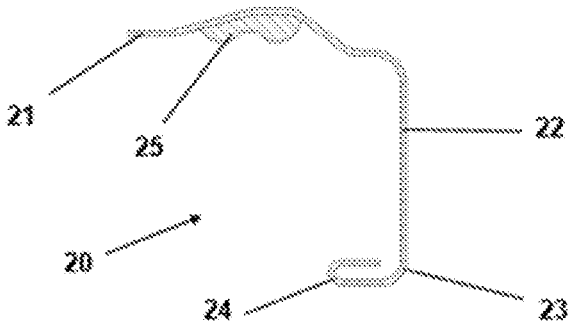
FIG. 4 shows a front partial section view of the lid of FIG. 3.

As shown in FIGS. 3 and 4, the closing lid 20 is bowl-shaped, with the upper part 21 being substantially planar and the peripheral skirt 22 projecting downwardly from the upper part 21. The free edge 23 of the skirt 22 ends in a rounded edge, and the free edge 23 comprises six lugs 24 along the periphery thereof, in correspondence with the six threads 131-136, which are inwardly extending folds of the skirt 22. The six lugs 24 are configured for being coupled with the six threads 131-136 of the screw thread 13 in a corresponding manner when the closing lid 20 is closed on the opening 11 of the body 10, such that they are positioned under and in contact with the threads 131-136.

The container 100 further comprises at least one element for easy opening housed between the screw thread 13 of the neck 12 and the lugs 24 of the closing lid 20. The element for easy opening is configured for being removed from between the screw thread 13 and the lugs 24 before opening the closing lid 20, the distance existing between the sealing edge 14 and the lugs 24 of the closing lid 20 decreasing, which means that the frictional force existing between the closing lid 20 and the neck 12 decreases. The subsequent opening of the closing lid 20 is thereby made easier.

In the embodiment shown in FIG. 1, the element for easy opening is a removable strip 30 securely arranged in place between the screw thread 13 of the neck 12 and the lugs 24 of the closing lid 20, covering the screw thread 13.

Figure 6:
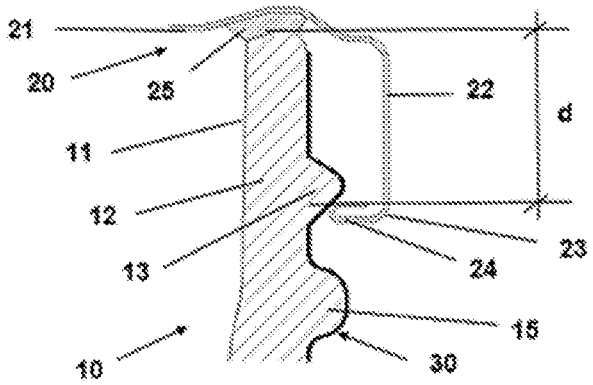
FIG. 6 shows a front partial section view of the closure of the container of FIG. 1, with the element for easy opening
Figure 7:
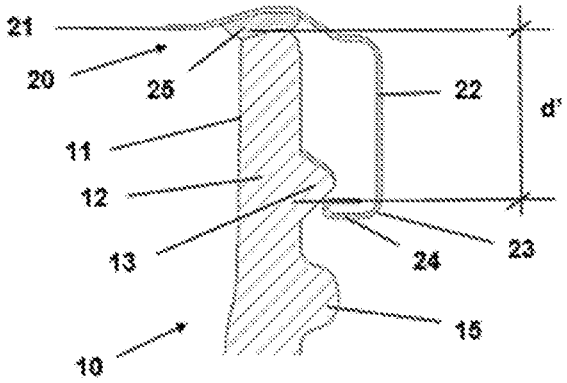
FIG. 7 shows a front partial section view of the closure of the container of FIG. 1, with the element for easy opening having been removed.

In this embodiment, the removable strip 30 surrounds the neck 12 of the body 10 and is ring-shaped. Specifically, as shown in FIG. 1 and in FIGS. 5 to 7, the strip 30 is arranged adhered to the neck 12 covering the six threads 131-136 of the screw thread 13 of the neck 12, such that with the closing lid 20 being closed on the opening 11 of the body 10, when each of the six lugs 24 of the closing lid 20 is positioned below each of the six threads 131-136, the lugs 24 are also in contact with the strip 30. The distance between the sealing edge 14 of the neck 12 and the lugs 24 is d. With the closing lid 20 closed on the opening 11, if the strip 30 is removed from the container 100, the initial distance d decreases, with a new distance d' being formed, and even though it does not break the vacuum seal inside the container 100, it causes the opening force Fa required for opening the closing lid 20 of the container 100 to decrease, as the frictional force between the closing lid 20 and the neck 12 decreases.

Figure 5:
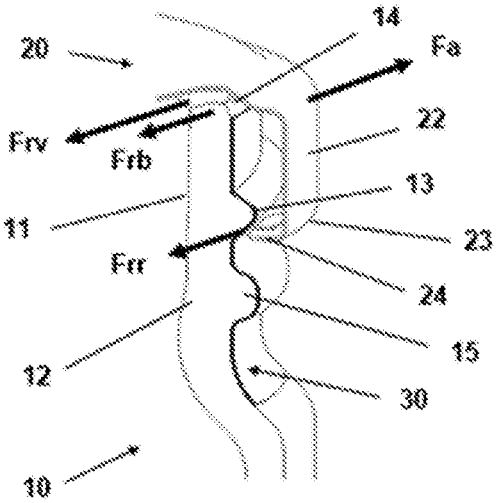
FIG. 5 shows a partial section perspective view of the closure of the container of FIG. 1, showing the forces that act in the opening of the container.

In the container 100 of FIG. 1, the product inside the container 100 is treated such that an internal pressure that is lower than atmospheric pressure is obtained. This preservation technique has the drawback that the internal pressure causes a pressing force of the closing lid 20 on the sealing edge 14 of the body 10 of the container 100, which causes, as shown in FIG. 5 with a partial section perspective view of the closure of the container 100 of FIG. 1, a frictional force due to the vacuum Fry which, in addition to the frictional force due to the contact of the closing lid 20 on the sealing edge 14 Frb, and of the closing lid 20 on the screw thread 13 Frr, generates a sum of frictional forces that must be overcome with an opening force Fa in order to open the closing lid 20 of the container 100. This is represented by the following formula, with D being the diameter in which the respective force is applied:

$$D*Frv+D*Frb+D*Frr<D*Fa$$

By removing the strip 30 before opening the closing lid 20, the frictional force of the closing lid 20 on the screw thread 13 Frr is reduced, therefore reducing the force that must be used by the user to open the container 100.

As can be seen in FIG. 1, in this embodiment the body 10 comprises a peripheral edge 15 below the screw thread 13 that surrounds the neck 12, the strip 30 covering the peripheral edge 15. The strip 30 is arranged below the sealing edge 14, being prolonged in this embodiment to a height that is below the peripheral edge 15. In this embodiment, therefore, the strip 30 covers the plurality of threads 131-136 of the container, although in other embodiments it may cover only one or some of the threads and/or it may only partially cover them.

As seen in FIG. 1, the strip 30 comprises a weakened line 32 which is scored in sections running along the strip 30 transversely, dividing it in two. This allows the user to tear the strip 30 in the weakened area 32 when pulling on it in order to remove it. The weakened line 32 is a line that is curved in the direction in which the strip 30 will be pulled.

Figure 8:
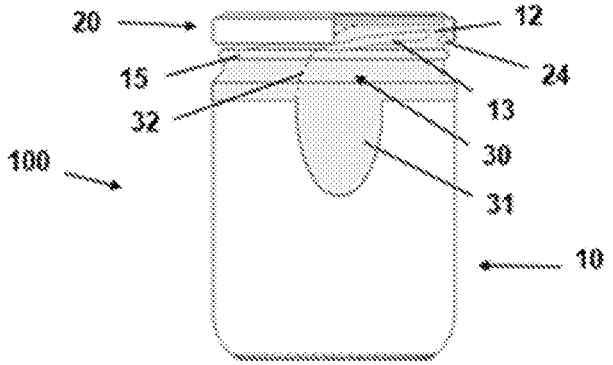
FIG. 8 shows a second embodiment of a container with a partial section of the lid showing an element for easy opening with a tab and a scored area.

FIG. 8 shows a second embodiment of the container 100. This embodiment includes, in addition to the features described for the first embodiment, a tab-like projection 31 projecting towards the lower part of the body 10. This projection 31 allows the user to pull on it for removing the strip 30. The weakened line 32 is arranged on one side of the projection 31.

Figure 9:
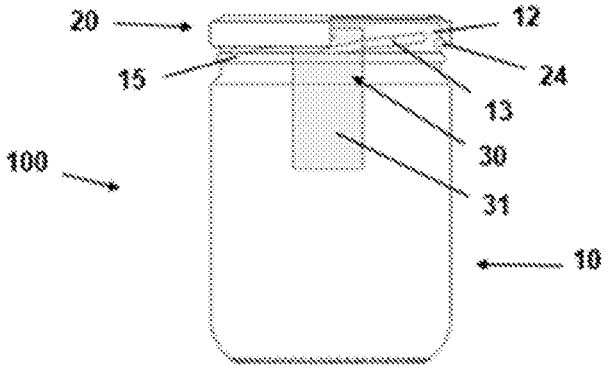
FIG. 9 shows a third embodiment of a container with a partial section of the lid showing an element for easy opening with a tab.

In a third embodiment shown in FIG. 9, instead of surrounding the neck 12, the removable strip 30 is arranged vertically and comprises a tab-like end 31 on which the user can pull. The strip could be arranged obliquely. The container could have a plurality of strips 30 arranged equidistantly from one another.

The element for easy opening of the container 100 of the invention can be made of a polymer, paper, cardboard, metallic film, fabric or a combination of the materials, where the element for easy opening can be secured in place by means of applying an adhesive.

According to one embodiment, the element for easy opening is a shrink-wrap film that is shrink-wrapped on the neck 12 of the body 10 by applying temperature. This embodiment is particularly advantageous in those embodiments in which the element for easy opening is a strip 30 surrounding the neck 12 of the body 10, as occurs in the first and the second embodiments that have been described.

Figure 10:
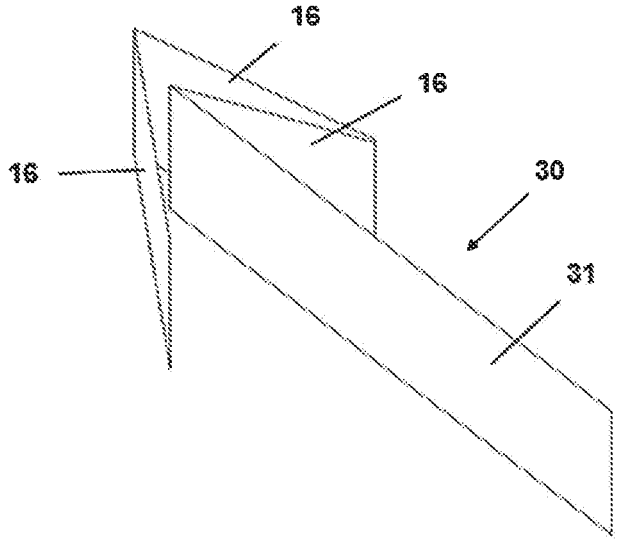
FIG. 10 shows a perspective view of another embodiment of the element for easy opening together with intermediate elements.

FIG. 10 shows a perspective view of an embodiment of the element for easy opening, in which the element for easy opening is a strip 30 with a tab-like projection 31 which forms a single part with a plurality of intermediate elements 16, forming a plurality of folds. When the part is housed between the at least one screw thread 13 of the neck 12 and the at least one lug 24 of the closing lid, two intermediate elements 16 are arranged between the strip 30 and the screw thread 13, and an intermediate element 16 is arranged between the strip 30 and the lug 24, two of the intermediate elements 16 remaining between the screw thread 13 and the lug 24 once the strip 30 has been removed. The effort made by the user in order to remove the strip 30 is therefore less because by removing the strip 30 and forming a single part with the intermediate elements 16, some of the intermediate elements 16 will be removed, with the removal being progressive.

In still another embodiment of the container (not depicted), the container comprises a plurality of separate intermediate elements forming a multi-layer assembly together with the element for easy opening. At least one intermediate element is arranged between the element for easy opening and the screw thread and/or between the element for easy opening and the lug, at least one intermediate element remaining between the screw thread and the lug once the element for easy opening has been removed.

Figure 11:
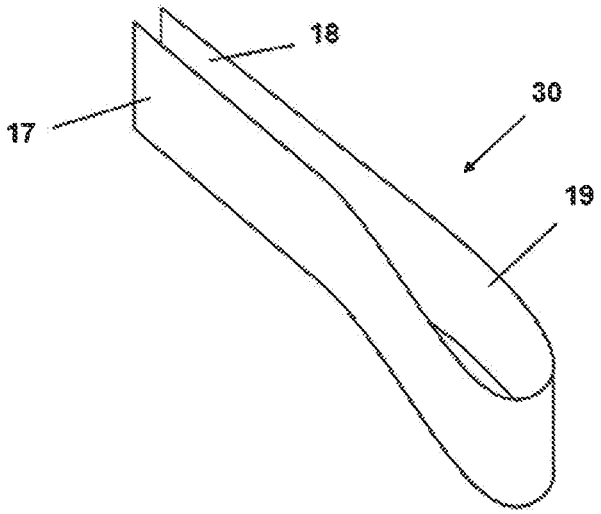
FIG. 11 shows a perspective view of another embodiment of the element for opening with a handle-like fold.

FIG. 11 shows a perspective view of another embodiment of the element for easy opening, in which the element for easy opening is a strip 30 comprising a first end 17 and a second end 18, both ends 17 and 18 being joined together and housed between the screw thread 13 of the neck 12 and the lug 24 of the closing lid 20, with a handle-like fold 19 being formed in the strip 30. Removal of the element for easy opening is therefore made much easier for the user, for example by inserting a finger into the fold 19 and pulling in order to remove the strip 30.

The following clauses disclose in an unlimited way additional embodiments.

Clause 1: An easy opening container comprising a body (10) with an opening (11), and a closing lid (20) for closing the opening (11), the opening (11) comprising a neck (12) comprising at least one screw thread (13) and a sealing edge (14), and the closing lid (20) comprising an upper part (21) and a peripheral skirt (22), the skirt (22) comprising a free edge (23), the free edge (23) including at least one inwardly extending lug (24), the lug (24) being configured for being coupled with a screw thread (13) of the neck (12) when the closing lid (20) is closed on the opening (11) of the body (10), the container including at least one element for easy opening housed between at least one screw thread (13) of the neck (12) and at least one lug (24) of the closing lid (20) coupled to the screw thread (13), the element for easy opening being configured for being removed before opening the closing lid (20) in order to make the subsequent opening of the closing lid (20) easier.

Clause 2: The container according to clause 1, wherein the element for easy opening is a removable strip (30) securely arranged in place between at least one screw thread (13) of the neck (12) and at least one lug (24) of the closing lid (20), coupled to the screw thread (13), at least partially covering the screw thread (13).

Clause 3: The container according to clause 2, wherein the strip (30) is arranged below the sealing edge (14).

Clause 4: The container according to clause 2 or 3, wherein the removable strip (30) surrounds the neck (12) of the body (10).

Clause 5: The container according to clause 4, wherein the strip (30) comprises a tab-like projection (31) projecting towards the lower part of the body (10).

Clause 6: The container according to clause 4 or 5, wherein the strip (30) comprises a weakened line (32) running along the strip (30) partially or completely in the transverse direction.

Clause 7: The container according to clause 2 or 3, wherein the removable strip (30) is arranged vertically or obliquely and comprises a tab-like end (31).

Clause 8: The container according to clause 2 or 3, wherein the strip (30) comprises a first end (17) and a second end (18), both ends (17, 18) being housed between the screw thread (13) of the neck (12) and the lug (24), and the strip (30) comprising a handle-like fold (19).

Clause 9: The container according to any of the preceding clauses, wherein the element for easy opening is made of a material selected from a polymer, paper, cardboard, metallic film, fabric or a combination of the materials, the element for easy opening being secured in place preferably by means of applying an adhesive.

Clause 10: The container according to any of clauses 1 to 8, wherein the element for easy opening is a shrink-wrap film that is shrink-wrapped on the neck (12) of the body (10) by applying temperature.

Clause 11: The container according to any of the preceding clauses, comprising at least one intermediate element (16) between the element for easy opening and the screw thread (13), and/or between the element for easy opening and the lug (24).

Clause 12: The container according to clause 11, wherein the element for easy opening and the at least one intermediate element (16) form a multi-layer assembly, the at least one intermediate element (16) preferably being housed between the screw thread (13) and the lug (14) once the element for easy opening is removed.

Clause 13: The container according to clause 11, wherein the element for easy opening and the at least one intermediate element (16) form a single part with at least one fold.

Clause 14: The container according to any of the preceding clauses, comprising a plurality of screw threads (131-**13*n*) and a plurality of lugs (24**).

Clause 15: A method for opening an easy opening container according to any of the preceding claims, the method comprising removing the element for easy opening from the container before opening the closing lid (20).

What is claimed is:

1. A container comprising:

a body having an opening that includes a neck, the neck including a screw thread and a sealing edge;

a closing lid for closing the opening, the closing lid including an upper part and a peripheral skirt, the peripheral skirt having a free edge including an inwardly extending lug, the inwardly extending lug being coupled with the screw thread of the neck when the closing lid is closed on the opening of the body; and an element for easy opening housed between the screw thread of the neck and the inwardly extending lug of the closing lid, the element for easy opening being removable from between the screw thread and inwardly extending lug before a removal of the closing lid from the container body, when the element for easy opening is housed between the screw thread and inwardly extending lug a first frictional force exists between the screw thread and inwardly extending lug, when the element for easy opening is removed from between the screw thread and inwardly extending lug a second frictional force less than the first frictional force exists between the screw thread and inwardly extending lug making the removal of the closing lid from the container body easier.

2. The container according to claim 1, wherein the neck includes a plurality of screw threads that are circumferentially offset from one another and the closing lid includes a plurality of inwardly extending lugs that are circumferentially offset from one another, the plurality of inwardly extending lugs being coupled with the plurality of screw threads when the closing lid is closed on the opening of the body, the element for easy opening being housed between the plurality screw threads and the plurality of inwardly extending lugs.

3. The container according to claim 1, wherein the element for easy opening is a strip of material securely arranged between the screw thread and the inwardly extending lug coupled to the screw thread, the element for easy opening at least partially covering the screw thread.

4. The container according to claim 1, wherein the neck includes a first screw thread and a second screw thread that is circumferentially offset from the first screw thread, the closing lid including a first inwardly extending lug and a second inwardly extending lug that is circumferentially offset from the first inwardly extending lug, the first and second inwardly extending lugs being respectively coupled with the first and second screw threads when the closing lid is closed on the opening of the body, the element for easy opening being housed between the first screw thread and first inwardly extending lug, the element for easy opening not being housed between the second screw thread and second inwardly extending lug.

5. The container according to claim 1, wherein the element for easy opening is a strip of material securely arranged between the screw thread and the inwardly extending lug coupled to the screw thread, the element for easy opening at least partially covering the screw thread.

6. The container according to claim 3, wherein the strip of material is arranged entirely below the sealing edge.

7. The container according to claim 3, wherein the strip of material at least partially circumferentially surrounds the neck of the body.

8. The container according to claim 7, wherein the strip of material comprises a tab-like projection projecting towards a lower part of the body.

9. The container according to claim 7, wherein the strip of material comprises a weakened line running along a portion of a length of the body.

10. The container according to claim 3, wherein the strip of material is arranged vertically or obliquely on the body and comprises a tab-like end.

11. The container according to claim 3, wherein the strip of material comprises a first end and a second end with each of the first and second ends being housed between the screw thread of the neck and the inwardly extending lug, and the strip comprising a handle-like fold.

12. The container according to claim 1, wherein the element for easy opening is made of a material selected from a polymer, paper, cardboard, metallic film, fabric or a combination of the materials.

13. The container according to claim 12, wherein the element for easy opening is secured on the body by an adhesive.

14. The container according to claim 1, wherein the element for easy opening is a shrink-wrap film that is heat-shrunk on the neck of the body.

15. The container according to claim 1, further comprising an intermediate element located between the element for easy opening and the screw thread, and/or between the element for easy opening and the inwardly extending lug.

16. The container according to claim 15, wherein the element for easy opening and the intermediate element form a multi-layer assembly, the intermediate element being housed between the screw thread and the inwardly extending lug when the element for easy opening is removed.

17. The container according to claim 15, wherein the element for easy opening and the intermediate element form a single part with at least one fold.

18. A method for opening a container, the method comprising:

providing a container, the container including a body having an opening that includes a neck, the neck including a screw thread and a sealing edge; the container further including a closing lid for closing the opening, the closing lid including an upper part and a peripheral skirt, the peripheral skirt having a free edge including an inwardly extending lug, the inwardly extending lug being coupled with the screw thread of the neck when the closing lid is closed on the opening of the body; the container further including an element for easy opening housed between the screw thread of the neck and the inwardly extending lug of the closing lid, the element for easy opening being removable from between the screw thread and inwardly extending lug before a removal of the closing lid from the container body, when the element for easy opening is housed between the screw thread and inwardly extending lug a first frictional force exists between the screw thread and inwardly extending lug, when the element for easy opening is removed from between the screw thread and inwardly extending lug a second frictional force less than the first frictional force exists between the screw thread and inwardly extending lug making the removal of the closing lid from the container body easier, removing the element for easy opening from between the screw thread and the inwardly extending thread; and twisting the closing lid in a counter-clockwise direction to decouple the inwardly extending lug from the screw thread after the element for easy opening has been removed from between the screw thread and the inwardly extending thread.

* * * * *